United States Patent [19]

Schroeder

[11] 4,075,592

[45] Feb. 21, 1978

[54] ELECTRICAL LOAD OUTAGE DETECTOR

[75] Inventor: Thaddeus Schroeder, Sterling Heights, Mich.

[73] Assignee: General Motors Corporation, Detroit, Mich.

[21] Appl. No.: 820,411

[22] Filed: Aug. 1, 1977

[51] Int. Cl.[2] ..... H01H 71/18

[52] U.S. Cl. ..... 337/139; 337/396

[58] Field of Search ..... 337/123, 124, 139, 382, 337/383, 396

[56] References Cited

U.S. PATENT DOCUMENTS

| | | | |
|---|---|---|---|
| 1,150,706 | 8/1915 | Ryan | 337/124 |
| 2,968,708 | 1/1961 | Sagona | 337/139 X |
| 3,174,012 | 3/1965 | Siiberg | 337/124 |

*Primary Examiner*—George Harris

*Attorney, Agent, or Firm*—Warren D. Hill

[57] ABSTRACT

An electrical switch comprises three flat terminals secured to an insulating base. The two outer terminals are arranged in the same plane and a third terminal is arranged midway between the outer terminals and has a contact portion which is spaced slightly from the plane of the outer terminals. An expansion strip is stretched between the outer terminals and when cold extends across the contact portion of the third terminal making contact with it. Load current from a circuit to be monitored is applied through the outer terminals and flows through the expansion strip thereby heating the strip so that it bows away from the third terminal. When the load current ceases, the expansion strip cools and contracts into contact with the third terminal thereby applying a voltage to that terminal from either of the outside terminals. A lamp or other current indicator in circuit with the third terminal indicates the stoppage of the load current.

2 Claims, 7 Drawing Figures

ELECTRICAL LOAD OUTAGE DETECTOR

This invention relates to an electrical load outage detector and more particularly to a current sensitive electrical switch for sensing the presence of a load current.

It has previously been known to provide a switch having an expansion strip for performing a switching function when the strip is heated by current flowing therethrough. Such devices have not assumed wide spread utilization probably because of expensive construction.

It is an object of the present invention, however, to provide such a switch designed especially for use as a load outage detector, useful for example, for sensing when a headlamp or other lamp on an automotive vehicle has burned out. In accordance with another object of the invention, such a detector is designed for automatic assembly and inexpensive construction.

The invention is carried out by providing three flat terminal strips each having an outer end serving as a spade or connector to an electrical circuit, and an inner end. The three terminals are secured to an insulating base. Two outer terminal strips are arranged in the same plane, while the third strip lies between the outer strips and has at least its inner end slightly spaced from the plane of the outer terminals. An expansion strip is secured to the inner ends of the outer terminal strips and when cool is urged into engagement with the inner end of the third strip. In one embodiment, a semi-conductor diode chip is bonded to the inner end of the third terminal and forms the contact between the third terminal and the expansion strip.

The above and other advantages will be made more apparent from the following specification taken in conjunction with the accompanying drawings wherein like reference numerals refer to like parts and wherein.

Figure 1:
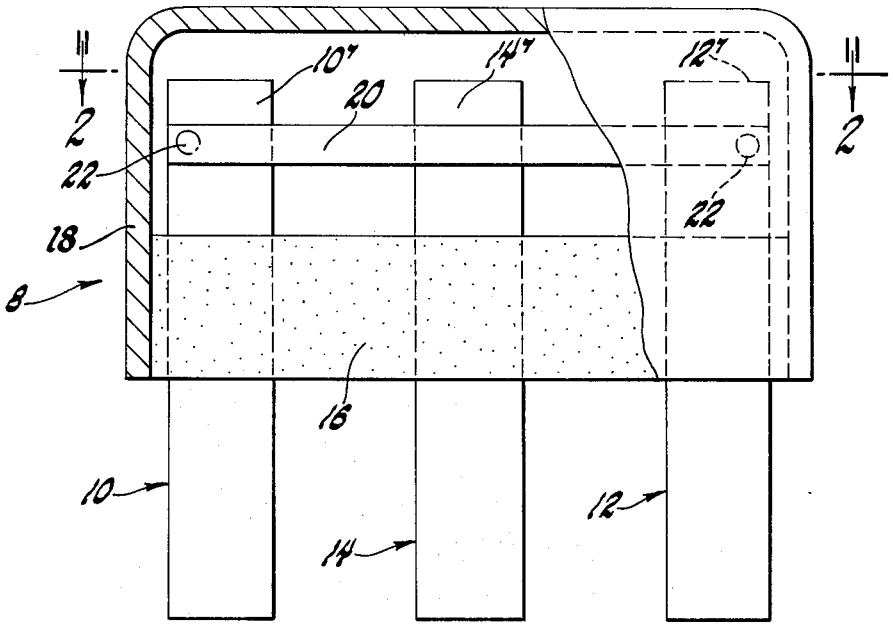
FIG. 1 is a plan view of an outage detector with the housing partly broken away according to the invention.
Figure 2:
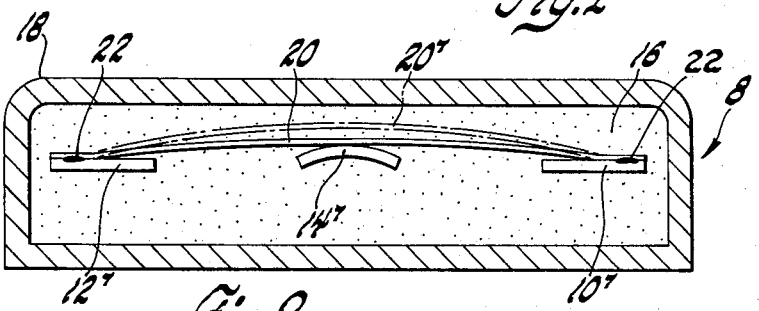
FIG. 2 is a view of the outage detector taken along line 2—2 of FIG. 1.

FIGS. 1 and 2 show an outage detector 8 comprising three parallel flat terminal strips 10, 12 and 14 lying generally in the same plane and secured to an insulating base 16 by being molded into the insulating material such as plastic or ceramic. Each terminal strip has an exposed outer portion serving as a flat spade-type connector and an inner portion 10', 12' and 14' enclosed within a housing 18. The inner portions 10' and 12' are flat while the inner portion 14' is curved, as shown in FIG. 2, to provide a contact surface projecting out of the plane defined by the flat terminal strips 10 and 12. An expansion strip 20 is secured by spot welds 22 to the inner terminal portions 10' and 12' and engages the curved terminal portion 14'. During welding, the expansion strip 20 is lightly prestressed to assure a firm contact with the portion 14' at ambient temperatures.

In operation, a current to be monitored is passed through the terminals 10 and 12 and the expansion strip 20 so that the strip becomes heated by the current and expands thereby bowing upwardly as shown by the broken lines 20' in FIG. 2 to disengage from the contact portion 14'. When the current is removed, the strip cools and contracts to contact the portion 14' thereby electrically connecting the terminal 14 with terminals 10 and 12. External circuitry sensitive to that condition is then able to indicate the cessation of current.

Specifically, for an outage detector designed for use with 3½ amp load currents flowing through the terminals 10 and 12, terminal strips 10, 12 and 14 are fashioned of stainless steel 304 having a thickness of 0.03", a length of 0.75" and a width of 0.155". The expansion strip is made of the same material and is 0.65" long between welds, 0.006" thick and 0.055" wide. The contact surface 14' is raised 0.017" above the plane of the terminal portions 10' and 12' to establish an angle of 3° between either end of the expansion strip and the plane of the terminals 10 and 12. Prior to welding, the expansion strip 20 is prestressed by a longitudinal force of about 9 oz. at ambient temperature to assure a positive contact force with portion 14'. The expansion strip has a thermal coefficient of expansion of $17.5 \times 10^{-6}/°$ C. When heated with a current of 3½ amps, the expansion strip assumes a steady-state temperature of 180° C above ambient to result in an expansion of 0.002". At the 3° angle between the expansion strip and the terminal plane, that amount of expansion results in a 0.0145" separation between the strip 20 and the contact portion 14' so that an amplification of 7.23 occurs. A voltage drop of 0.27 volt occurs across the terminals 10 and 12 and drop of 0.196 volt occurs across the expansion strip 10 which has a resistance of 0.056 ohms. The switch formed by element 14' and 20 opens 0.67 seconds after current is applied and it takes 4.9 seconds for the switch to close when current is removed. The response times are readily altered to vary the time distribution between the opening mode and the closing mode. For example, opening response times from 0.5 to 5 seconds are readily attained. As the opening response time increases, the closing response time decreases by a like amount. The variation in the response times is effected chiefly by varying the amount of prestress longitudinally applied to the expansion strip 20 at the time of welding as well as adjustments in the offset of the contact point of portion 14' from the plane of the terminals 10', 12'. When the offset is selected so small that the angle of the expansion strip approaches zero degrees, the switch becomes more sensitive and in fact, too sensitive, such that any slight temperature variation will cause sufficient creep to open the switch. If on the other hand the angle is made too large, the switch loses sensitivity. The choice of an angle of about three degrees provides a sensitive switch which is both stable and reliable. The material of the insulating base 16 is chosen to have a thermal coefficient of expansion compatible with that of the metallic structures of the switch so that the switching characteristics are not greatly effected by the ambient temperature of the device. Epoxy filled with glass fibers has a coefficient similar to that of stainless steel.

Other materials may be used for the terminals and the expansion strip such as berryllium copper and phosphor bronze, for example. Depending on the choice of the materials and the amount of prestressing, the response times can be varied from several milliseconds to several seconds.

The outage detector has an inherent thermal hysteresis which practically eliminates contact bouncing. As long as the expansion strip 20 touches the contact portion 14', a portion of the heat generated in the strip by the flowing current escapes into the output terminal. Once the expansion strip moves even slightly away from the contact portion, the heat escape to terminal 14 is stopped and the current will heat the strip rapidly to a higher temperature and cause it to move even farther away from the output terminal. Thus, once the contact opens, it cannot close unless the current is sufficiently reduced. As a result, a virtually bounceless switching is achieved.

Figure 3:
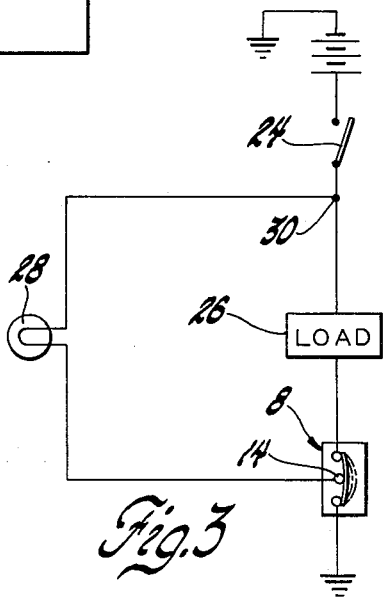
FIG. 3 is a schematic circuit diagram illustrating an application of the outage detector of FIG. 1.

FIG. 3 shows outage detector circuitry that includes a switch 24, a load 26 and the outage detector 8 which are serially connected from a voltage source to ground. An outage indicator lamp 28 is connected between the terminal 14 of the outage detector and a junction point 30 between the switch 24 and the load 26. When the switch is initially closed and the outage detector is at ambient temperature, current will flow through the lamp 28 and the terminal 14 of the outage detector and will cause illumination of the lamp assuming a sufficiently long response time of the outage detector to enable illumination of the lamp. This provides a visual indication of the lamp integrity. The flow of load current through the outage detector, heats the expansion strip 20 causing it to separate from the terminal 14 thereby terminating any current through the indicator lamp 28. If the load 26 fails while the switch 24 is closed to open the circuit between the junction 30 and the outage detector, the expansion strip will contract to engage the terminal 14 thereby allowing current flow through the lamp 28 to illuminate that lamp to indicate the outage of the load 26.

Figure 4:
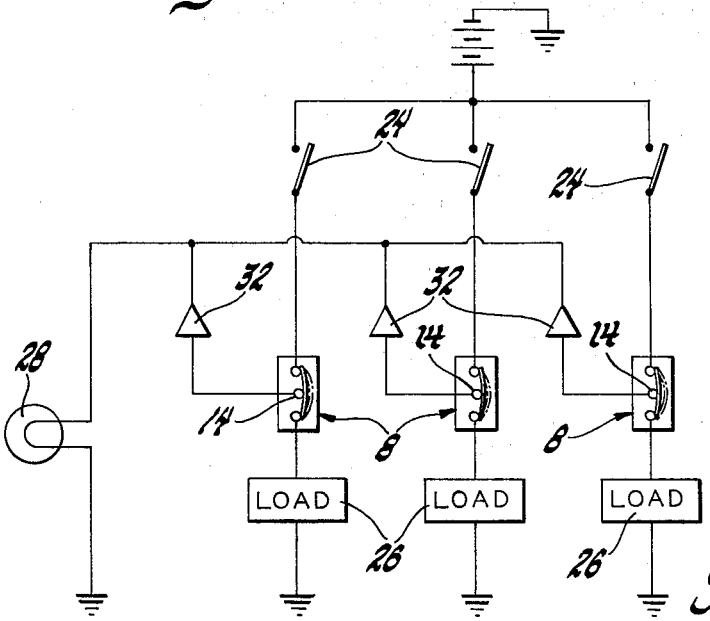
FIG. 4 is a schematic circuit diagram of a circuit utilizing a plurality of outage detectors according to the invention.

FIG. 4 shows an outage indicator circuit for a plurality of loads which includes three parallel load circuits each connected between a voltage source and ground and containing in series a switch 24, an outage detector 8 and a load 26 in that order. The terminal 14 of each outage detector is connected through a diode 32 to a common outage indicator lamp so that the current from terminal 14 of any of the outage detectors 8 will illuminate the outage indicator lamp 28 whenever its respective load 26 produces an open circuit condition. The diodes prevent current flow to others of the loads.

Figure 5:
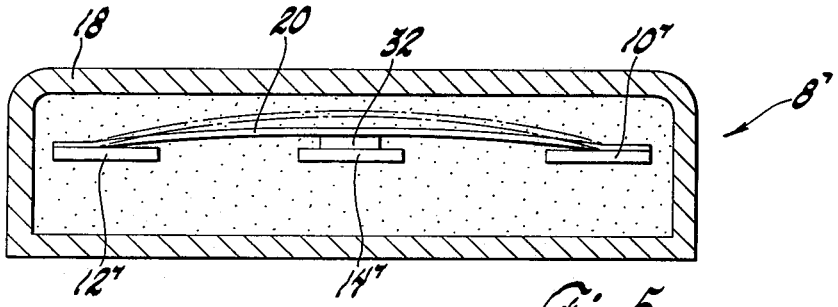
FIG. 5 is a modified embodiment of the outage detector of FIG. 1, particularly adapted for use in the circuit of FIG. 4.

FIG. 5 shows an outage detector 8' specifically modified for the FIG. 4 circuit application. The detector 8' is the same as the detector 8 shown in FIGS. 1 and 2 except that the inner portion 14' of the center terminal strip is flat and in the plane of the terminal portions 10' and 12' and carries on the surface thereof a semi-conductor diode chip 32 bonded to the contact portion 14' preferably by soldering. The diode chip 32 is mounted directly beneath the expansion strip 20 so that it produces the necessary offset of the contact point relative to the plane of the terminals 10 and 12 and in addition serves as the point of contact between the expansion strip 20 and the inner contact portion 14'. As in FIG. 4 the diode prevents feedback of current from the indicator lamp circuit to the load in series with the outage detector.

Figure 6:
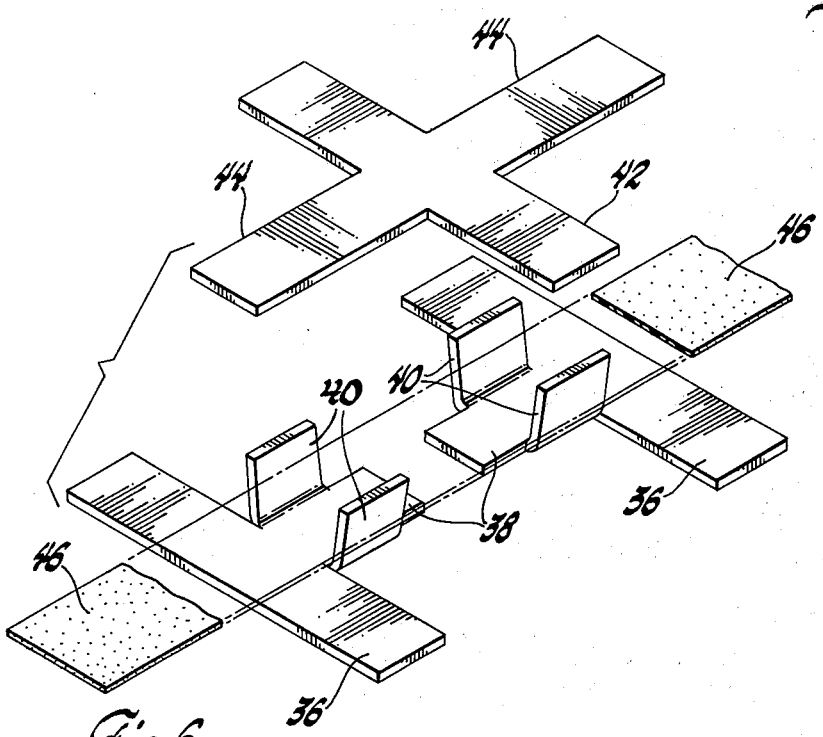
FIGS. 6 and 7 are perspective views of still another embodiment of the outage detector according to the invention.
Figure 7:
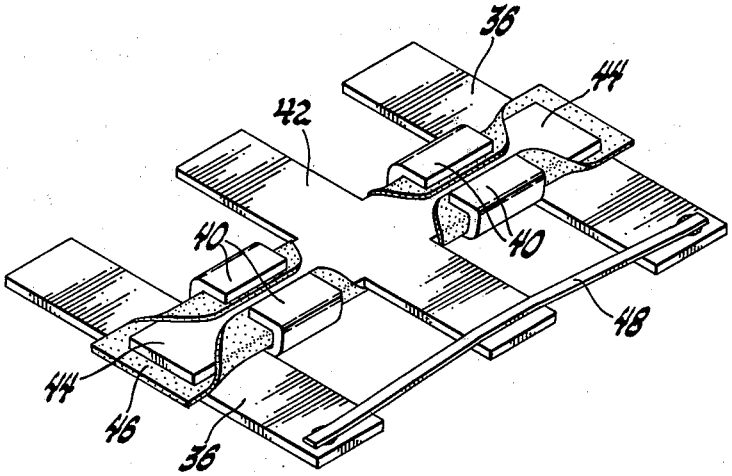

FIGS. 6 and 7 show another embodiment of the outage detector. As shown in exploded form in FIG. 6, the three terminal portions of the detector are shown as preformed blanks. The two outer terminals have blanks comprising straight terminal strips 36 with integral lateral arm extensions 38 extending from one side thereof, each arm 38 supporting a pair of upstanding ears 40. The left and right terminal strips 36 are formed symmetrically so that upon assembly, the arms 38 of each extend inwardly toward the arm of the other. The center terminal includes a straight flat terminal strip 42 having a pair of intermediate laterally oppositely extending arms 44 so that the blank defines a cross shape. Upon assembly as shown in FIG. 7, a film of insulating plastic material 46 is placed between the terminals 36 and terminal 42, the arms 44 of the center terminal lie above the arms 38 of the terminals 36, and the ears 40 are crimped around the arms 44 to secure the three terminal portions into an integral unit separated only by the insulating film 46. The flat terminals 36 lie in one plane and the terminal 42 is in another plane slightly spaced from the first, the spacing defined by the thickness of the terminal 42 itself and the thickness of the plastic film 46. An expansion strip 48 is stretched across the three terminal strips and welded to the outer strips 36 to define a functional structure like that described for FIGS. 1 and 2. The opposite ends of the terminals define connector spades. The assembly is completed by adding a molded plastic housing, not shown, of desired configuration.

It will thus be seen that the outage detector according to the subject invention comprises a current sensitive switch of extreme simplicity and a very low cost, yet offering high reliability and virtually bounceless switching.

The embodiments of the invention in which an exclusive property or privilege is claimed are defined as follows:

1. An electrical load outage detector comprising first, second and third terminal strips secured together in a rigid assembly with insulating material therebetween, each terminal strip having a flat portion comprising a terminal connector at one end, the first and second terminal strips comprising input and output terminals respectively connectable to a load circuit, the flat portions of the first and second terminal strips being spaced apart and lying in a first plane, the third terminal strip having a contact portion disposed between and slightly spaced from the plane of the flat portions of the first and second terminal strips, an elongate thermally responsive expansion strip of conductive material fixedly connected at its ends to the flat portions of the first and second terminal strips to prevent longitudinal movement of the said ends and for electrically interconnecting the first and second terminal strips to carry load current therebetween, the expansion strip when unheated being slightly bowed and stressed into firm engagement with the contact portion of the third terminal strip to electrically interconnect the first, second and third terminal strips, the expansion strip having sufficient resistance to be significantly heated by the load current for longitudinal expansion when heated by load current flow to effect further bowing of the expansion strip and consequent movement away from engagement with the contact portion of the third terminal strip thereby electrically disconnecting the third terminal strip from the first and second terminal strips.

2. An electrical load outage detector comprising first, second and third terminal strips secured together in a rigid assembly with insulating material therebetween, each terminal strip having a flat portion comprising a terminal connector at one end, the first and second terminal strips comprising input and output terminals respectively connectable to a load circuit, the flat portions of the first and second terminal strips being spaced apart and lying in a first plane, the third terminal strip having a flat portion disposed between the flat portions of the first and second terminal strips, a semi-conductor diode chip bonded to the flat portion of the third terminal strip to form a contact portion slightly spaced from the said first plane, an elongate thermally responsive expansion strip of conductive material fixedly connected at its ends to the flat portions of the first and second terminal strips to prevent longitudinal movement of the said ends and for electrically interconnecting the first and second terminal strips to carry load current therebetween, the expansion strip when unheated being slightly bowed and stressed into firm engagement with the contact portion of the diode chip to electrically interconnect the first, second and third terminal strips and the diode, the expansion strip having sufficient resistance to be significantly heated by the load current for longitudinal expansion to effect further bowing of the expansion strip and consequent movement away from engagement with the contact portion of the diode chip thereby electrically disconnecting the third terminal strip and the diode from the first and second terminal strips.

* * * * *